United States Patent [19]

Jukkola et al.

[11] 4,343,246

[45] Aug. 10, 1982

[54] SLURRY COAL FEED SYSTEM FOR FLUIDIZED BED REACTOR

[75] Inventors: Walfred W. Jukkola; Thomas D. Heath, both of Westport, Conn.

[73] Assignee: Dorr-Oliver Incorporated, Stamford, Conn.

[21] Appl. No.: 138,188

[22] Filed: Apr. 7, 1980

[51] Int. Cl.[3] ..... F23G 7/00

[52] U.S. Cl. ..... 110/222; 110/104 R; 110/106; 110/245

[58] Field of Search ..... 110/106, 101 R, 101 CF, 110/104 R, 101 CA, 104 B, 222, 245

[56] References Cited

U.S. PATENT DOCUMENTS

| | | | |
|---|---|---|---|
| 2,259,967 | 10/1941 | Vogel-Jorgensen | 110/106 |
| 2,716,002 | 8/1955 | Crag | 110/106 |
| 3,250,016 | 5/1966 | Aganwal | 110/106 |
| 3,848,548 | 11/1974 | Bolejack, Jr. et al. | 110/222 |
| 3,857,487 | 6/1971 | Makuch | 110/101 R |
| 3,884,162 | 5/1975 | Schuster | 110/222 |
| 3,888,194 | 6/1975 | Kishigami et al. | 110/245 |
| 3,897,739 | 8/1975 | Goldbach | 110/245 |
| 4,092,094 | 5/1978 | Lingl, Jr. | 110/104 R |

FOREIGN PATENT DOCUMENTS

| | | | |
|---|---|---|---|
| 54-16730 | 2/1979 | Japan | 110/245 |

*Primary Examiner*—Henry C. Yuen

*Attorney, Agent, or Firm*—Harold M. Snyder; Burtsell J. Kearns

[57] ABSTRACT

A system for the comminution of coal, slurry formation and feed of the coal slurry to a fluidized bed reactor.

1 Claim, 1 Drawing Figure

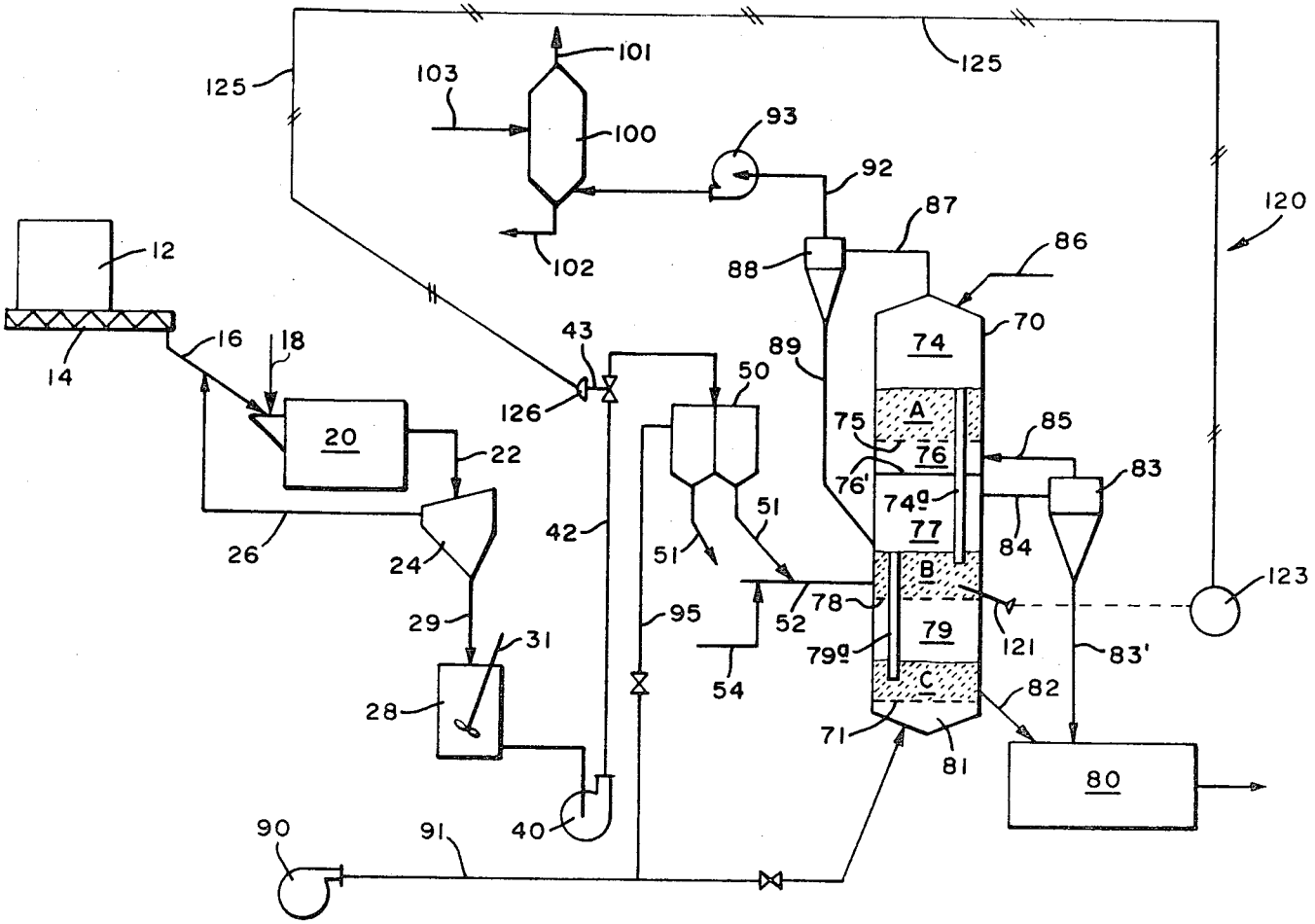
120
123
125
125
83
83'
80
86
85
84
121
82
70
74
A
76
74a
77
B
79
C
81
87
75
76'
78
79a
71
92
89
52
93
88
50
51
54
51
95
101
100
102
43
42
40
126
22
31
103
24
29
28
91
20
18
26
90
16
12
14

SLURRY COAL FEED SYSTEM FOR FLUIDIZED BED REACTOR

This invention is directed to a system for employing a coal slurry as the fuel for fluidized bed calciners or incinerators or other combustion systems.

Most existing fluidized bed calciners and incinerators were designed for operation using gas and liquid fuels. The rising cost and growing scarcity of such fuel has led to increased attention being devoted to the enormous coal reserves which are available and which could, potentially, replace gas and liquid fuels in fluidized bed systems.

The use of coal as fuel presents many problems such as possible fires, explosion hazards and handling difficulties due to the varying chemical and physical properties of coal as received at the plant for use. The characteristics of the coal are largely dependent upon its rank or source. Coals are typically classified as Anthracite, Bituminous, Semibituminous or Lignites dependent upon age, chemical analysis, volatile composition, physical characteristics, etc. with each rank having particular characteristics.

Elaborate and complex systems have been devised for coal preparation, but such systems are only feasible where very large tonnages of coal are to be prepared and consumed. However, there exists a need for a system of coal preparation for an operation which uses only a fraction of a ton, or perhaps a few tons per hour, as fuel and therefore does not justify a complex fuel preparation system.

Accordingly, it is an object of this invention to provide a simple fuel handling system which is suitable for all types of coals and overcomes potential fire and explosion hazards and is environmentally attractive.

Other objects and advantages of the invention will become apparent in the following description, taken in conjuction with the accompanying drawing in which:

The FIGURE is a schematic diagram of a coal slurry preparation system for a fluidized bed calciner in accordance with this invention.

Generally speaking, the fuel preparation and feed system of the invention wherein slurry coal is used as fuel is employed in association with a fluidized bed reactor having a combustion zone, and comprises a coal bin, a coal crusher having an inlet for water, means for withdrawing coal from the bin and forwarding it to the crusher, a slurry tank having agitating means therein, slurry coal feed guns for directing a flow of coal slurry into said combustion zone, means for supplying slurry coal from said slurry tank to the slurry coal feed guns and means responsive to the temperature in said combustion zone to control flow of coal slurry to said feed guns.

In the FIGURE, a screw feed mechanism 14 is positioned to withdraw coal from the coal bin 12 and move it to conduit 16 which is connected to the impact crusher 20. The impact crusher 20 has a water inlet 18 and a slurry outlet conduit 22 for removing the crushed, slurried coal from the crusher. The fine, crushed coal, which is minus ⅛" size and, preferably, about 10 mesh, flows as a slurry through conduit 22 to the vibrating screen 24. Oversize from the screen 24 is recycled to the crusher 20 through conduit 26 while the slurry passing through screen 24 is routed to storage tank 28 which is provided with agitating means 29 through conduit 29. A feed pump 40 moves the slurry coal from tank 28 either directly to fuel guns 52 or first, via conduit 42, to a pressurized distribution box 50 which divides the slurry flow for delivery to a plurality of fuel guns 52 through conduits 51.

The fluidized bed calcining reactor 70 is a multicompartment reactor having a preheat compartment 74 separated from a windbox 76 by a constriction plate 75. The calcining compartment 77 is separated from the windbox 76 by a solid partition 76'. A constriction plate 78 separates the calcining compartment 77 from the cooling compartment 79. A windbox 81 is separated from the cooling compartment 79 by the constriction plate 71. The fluidizing air blower 90 supplies fluidizing air to the windbox 81 through the conduit 91. The material to be calcined is supplied to the preheat compartment 74 through conduit 86. The calcined, partially cooled product is withdrawn from cooling compartment 79 through conduit 82 to a calcine cooling system 80 in which the cooling process is completed.

The fluidizing air supplied to windbox 81 traverses the constriction plate 71 to fluidize the cooling bed C in cooling compartment 79 and, in the process, is heated to a somewhat elevated temperature. This heated air rises through cooling compartment 79 and traverses the constriction plate 78 to fluidize the bed in the calcining compartment 77. In that chamber combustion occurs and the gases which rise through calcining compartment 77 are quite hot. These gases are routed through conduit 84 to the cyclone 83, where entrained solids are removed through conduit 83' to the calcining cooling system 80. The hot gases leave the cyclone 83 through conduit 85 through which the are routed to the windbox 76. The hot gases from windbox 76 traverse the constriction plate 75 to fluidize the bed in the preheat compartment 74. In rising through the fluidized bed the gases are cooled considerably and pick up a substantial amount of moisture. The gases from preheat compartment 74 exit through conduit 87 and are conducted to the cyclone 88 where entrained solids are separated and returned to the calcining compartment 77 through conduit 89, while the gases drawn from cyclone 88 through the conduit 92 by the exhaust fan 93 are directed to the scrubber 100. Scrubber water is introduced into the scrubber 100 through the conduit 103. The scrubbed gases leave the scrubber 100 through conduit 101 for discharge or further treatment while liquids depart the scrubber through conduit 102.

Considering now the solids flow in reactor 70, the material to be calcined is introduced through the conduit 86 to the preheat compartment 74 where it forms fluidized bed A resting on the constriction plate 75. The overflow transfer pipe **74*a* is provided extending from a position well within the preheat compartment 74, through the constriction plate 75 and partition 76' to a position below the upper surface of the fluidized bed B in the calcining compartment 77. The fluidized bed A in precooling cooling compartment 74 reaches the upper lip of the transfer pipe 74*a* as material is added to the compartment and, with the bed fluidized, preheated bed material overflows the lip and falls into calcining compartment 77**.

The solids introduced into calcining compartment 77 through the transfer pipe **74*a* form a fluidized bed B in that chamber resting on the constriction plate 78. A second transfer pipe 79*a* extends from well within calcining compartment 77 through constriction plate 78 into cooling compartment 79, well below the level of the fluidized bed C situated therein. This transfer pipe works in a manner identical to that just described, thus establishing the level of the fluidized bed B in compartment 79. In summary, it may be stated that the solids flow in reactor 70** is countercurrent to the gas flow through the reactor.

Automatic slurry coal feed is provided by a control circuit 120. This control circuit comprises a temperature sensor or thermocouple 121 located in the combustion zone of the fluidized bed reactor which is connected to a control instrument 123 which functions, through a pneumatic or electrical line 125 to actuate a valve operating means 126 for valve 43 in conduit 42. It will be seen that, through this control means, the flow of coal slurry through conduit 42 can be regulated by means of valve 43 in response to the temperature detected in fluidized bed B.

In forming the slurry, water is added int the rod mill coal crusher at a rate to form a slurry with solid concentration of 40 to 60% solids or, preferably, 50 to 55% solids.

The system of the invention has the advantage of being able to handle any type of moisture content coals, the crushing and slurry preparation can be carried out on a batch basis in a short period of time, and it eliminates coal dust problems. The system is particularly attractive for plants requiring small quantities of fuel, say 100 lbs. to 5 TPH. It has been found that if the slurry concentration is maintained as high as possible or at least above 50 percent solids, the fuel requirements will increase by less than 12%.

The use of the slurry fuel system provides a simple, dust-free system for easy metering of coal into a hot pressurized fluidized bed. A maximum of about 2 gpm of slurry per gun should be introduced into the fluidized bed in order to maintain efficient combustion of the coal. In some instances, it will be feasible to feed the slurry into the reactor just above the fluidized bed level. However, in general, the introduction of the slurry below the surface of the bed but at least a foot above the constriction plate is the preferred operating method for maximum fuel efficiency.

Although the present invention has been described in conjunction with preferred embodiments, it is to be understood that modifications and variations may be resorted to without departing from the spirit and scope of the invention, as those skilled in the art will readily appreciate. Such modifications and variations are considered to be within the purview and scope of the invention and appended claims.

It will be understood that the distribution box 50 may be pressurized by diverting a portion of the air flow from fluidizing blower 90 to pressurized distribution box 50 by means of conduit 95. Of course, other means of effecting pressurization of the distribution box may be employed.

We claim:

1. A solid fuel preparation and feed system, wherein slurry coal is the fuel feed to be employed, for a multi-compartment fluidized bed calciner having a preheat compartment, a calcining compartment, a precooler compartment and a blower for supplying fluidizing air to said calciner, comprising a coal bin, a coal crusher having an inlet for water, means for withdrawing coal from said bin and forwarding it to said coal crusher, a slurry storage tank having agitating means therein, means for withdrawing coal from said crusher and forwarding it to said slurry storage tank, slurry coal feed guns mounted on said fluidized bed calciner for directing a flow of coal slurry into said calcining compartment, a pressurized distribution box between and connected by conduits to said slurry tank and said fuel guns for dividing the slurry flow from said slurry storage tank for delivery to a plurality of said fuel guns, means for diverting a portion of the air from said blower to said pressurized distribution box to effect pressurization thereof and control means responsive to the temperature in said calcining compartment to actuate valve means in said conduit between said distribution box and said slurry storage tank to adjust the flow of coal slurry to said feed guns as required by the system.

* * * * *